United States Patent [19]

Churchill et al.

[11] Patent Number: 5,033,433

[45] Date of Patent: Jul. 23, 1991

[54] THROTTLE WITH CO-AXIAL STEPPER MOTOR DRIVE

[75] Inventors: Jonathan D. Churchill, Sheboygan; Martin W. Heinrich, Plymouth; Matthew F. Slana, Sheboygan Falls, all of Wis.

[73] Assignee: Kohler Co., Kohler, Wis.

[21] Appl. No.: 538,290

[22] Filed: Jun. 14, 1990

[51] Int. Cl.[5] ..... F02D 11/04

[52] U.S. Cl. ..... 123/361; 123/399; 123/400; 464/162; 464/160; 464/120; 464/112; 464/106

[58] Field of Search ..... 123/361, 399, 400; 464/120, 112, 106, 162, 160

[56] References Cited

U.S. PATENT DOCUMENTS

| | | | |
|---|---|---|---|
| 3,201,648 | 8/1965 | Kerr | 123/361 |
| 4,043,148 | 8/1977 | Knapp | 464/106 |
| 4,112,885 | 4/1978 | Iwata et al. | 123/361 |
| 4,424,785 | 1/1984 | Ishida et al. | 123/399 |
| 4,541,378 | 9/1985 | Kitamura | 123/399 |
| 4,756,287 | 7/1988 | Sakakibara et al. | 123/361 |
| 4,773,370 | 9/1988 | Koshizawa et al. | 123/357 |
| 4,787,353 | 11/1988 | Ishikawa et al. | 123/399 |
| 4,823,749 | 11/1989 | Eisenmann et al. | 123/399 |
| 4,850,319 | 7/1989 | Imoehl | 123/361 |
| 4,860,708 | 8/1989 | Yamaguchi et al. | 123/399 |

*Primary Examiner*—Andrew M. Dolinar
*Assistant Examiner*—Thomas Moulis
*Attorney, Agent, or Firm*—Quarles & Brady

[57] ABSTRACT

A method of attaching a stepper motor to a throttle shaft provides constant torque transmission by connecting the shafts coaxially with a coupling that accommodates limited shaft misalignment and movement. In the preferred embodiment, the coupling comprises a fork, parallel to, and attached to, one shaft that receives a pin, perpendicular to, and attached to, the second shaft. The coupling permits the coaxial attachment of the shaft without the necessity of maintaining precise mounting tolerances.

4 Claims, 2 Drawing Sheets

THROTTLE WITH CO-AXIAL STEPPER MOTOR DRIVE

BACKGROUND OF THE INVENTION

1. Field of the Invention The invention relates to electronic speed regulators for internal combustion engines and in particular to throttle actuators for such regulators.

2. Background of the Art

The precise speed control of internal combustion engines is desired for many applications but is particularly important when such engines are used to drive AC generators. The speed of the engine determines the frequency of the generated power and many AC powered electrical devices require accurately regulated AC frequency. In addition, this accurate speed control must be maintained under rapid load variations which may result from nearly instantaneous changes in the consumption of electrical power from the generator. Variation in engine speed with change in engine load is termed "droop".

Engine speed control may be performed by a number of methods. A mechanical governor may sense the speed of rotation of the engine and open or close the throttle to regulate the engine speed in response to imputed load changes. Such mechanical control has the advantage of being relatively inexpensive, but may allow substantial droop during normal load variations.

More sophisticated engine speed control may be realized by sensing engine speed electronically and using an electro-mechanical actuator connected to the throttle to change the throttle position.

Typically, the electro-mechanical actuator is a linear or rotary actuator. As the names imply, a linear actuator has a control shaft which extends from the body of the actuator and moves linearly by a distance proportional to the magnitude of a current or voltage applied to the actuator. A rotary actuator has a shaft which rotates by an angle proportional to the magnitude of the applied current or voltage. In both actuators, a spring returns the shaft to a zero or "home" position when no voltage or current is applied to the actuator. The power consumed by these actuators is increased by the return spring whose force must be overcome.

Neither the linear nor rotary actuators may be connected directly to the rotating throttle. In the case of a linear actuator, a pitman arm must be used to convert the linear motion of the actuator to the rotary motion necessary to rotate the throttle valve through approximately 90°. For a rotary actuator which rotates approximately 15°–20° a "four-bar" linkage is required to increase the angular motion of its shaft. The power of the actuators must be sufficient to overcome the friction associated with these required mechanical linkages.

The power required by the use of a return spring and by the friction of the mechanical linkages increases the cost and weight of a throttle control using linear or rotary actuators. For these reasons, it is known to use a bidirectional stepper motor in place of a linear or rotary actuator for the purpose of electronic engine control.

A bidirectional stepper motor is an electro-mechanical device that moves a predetermined angular amount and direction in response to the sequential energization of its windings. When a bidirectional stepper motor is used to control the throttle, the return spring may be omitted or made weaker allowing the use of a smaller motor with equivalent or better dynamic properties than the linear or rotary actuators. Also, the digital nature of the stepper motor's input signal is well adapted for use with certain microprocessor based engine controls.

The use a lower powered bidirectional stepper motor requires that the connection between the stepper motor and the throttle valve is free of binding and unnecessary friction. The throttle shaft normally fits closely within the throttle body and as a result of the fuel saturated environment, operates without lubrication. The design of the stepper motor also requires that the motor shaft have little play to preserve the close tolerances of the internal magnetic gaps for maximum power. Accordingly, in order to prevent the binding of these shafts without the introduction of excessive rotational play, the stepper motor shaft and throttle shaft are typically joined by means of the four bar linkage used with a rotary actuator. A four bar linkage comprises a connecting rod attached by pivoting joints to two cranks, one crank attached to the throttle shaft and one to the stepper motor shaft. The fourth bar is implicit in the common mounting of the motor and throttle. This linkage provides an inexpensive and easily manufactured connection between the stepper motor shaft and the throttle shaft but one that accepts some misalignment.

The connecting rod of the four-bar linkage also permits the displacement of the stepper motor away from the throttle shaft to permit the attachment of a position feedback device to the throttle shaft. A position feedback device permits the measurement of absolute throttle position which is not determinable from the control inputs to the stepper motor, because the stepper motor may start in any position.

There are two disadvantages to the use of a four bar linkage to connect the stepper motor to the throttle shaft. First, the rotational range of the stepper motor is unnecessarily limited as the four bar linkage has a limited rotational range. Second, a feature of such a linkage is that the torque transmitted by the connecting rod varies markedly depending on the relative angles of the cranks to the connecting rod. Typically at the extremes of travel there is a "dead center" position where the linkage is ineffective. However, the transmission of torque is not constant at any angle. This problem is usually addressed by making the linkage adjustable so that the crank and connecting rod angles are centered to provide peak torque transmission at the angles appropriate for a particular throttle. This solution, however, requires that the linkage be adjustable or redesigned for different throttle and engine types.

SUMMARY OF THE INVENTION

The present invention permits a direct connection between a throttle shaft and a coaxial stepper motor shaft through a coupling that accommodates small amounts of misalignment. Specifically, the throttle shaft is attached to a throttle valve contained in a throttle housing so that rotation of the throttle shaft opens and closes the throttle valve controlling the flow rate of mixed air and fuel to the engine. The stepper motor is attached to the throttle housing so that its shaft is axially aligned with the throttle shaft. The two shafts are then connected with a co-axial coupling that provides a constant transmission of torque therebetween and accommodates angular, axial or translational misalignment between the shafts and axial or translation movement between the shafts.

It is one object of the invention to provide a cost effective method of connecting a throttle shaft to a stepper motor shaft. The direct connection of axially aligned shafts avoids the extra manufacturing steps of adjusting a four-bar linkage and provides a design that is easily transportable between engine types. The constant torque transmission of the co-axial coupling permits a more accurate sizing of the motor torque to the required throttle shaft torque. The co-axial coupling allows this direct connection, without binding of the shafts, by accommodating slight misalignment but without introducing significant rotational play. This permits the throttle shaft and coupling assembly to be manufactured with normal manufacturing tolerances.

The co-axial coupling may consist of an offset arm mounted on either the throttle or the motor shaft perpendicular to their axes. The offset arm has a guide fork with two guide bars extending parallel to, but displaced from, the axes of the shafts. A torque pin is attached to the opposing shaft extending perpendicularly to the axes of the shafts, for being received between faces of the guide bars. The guide bars may be spaced apart by the thickness of the torque pin and have convex faces.

It is another object of the invention, therefore, to provide an inexpensive and reliable co-axial coupling to permit the connection of axially aligned stepper motor and throttle shafts while accommodating some axial misalignment. The offset arm and torque pin may be pre-assembled to the shafts which may be later connected with a simple insertion of the torque pin into the guide bars. The use of closely spaced guide bars with convex faces permits the rotational play of the connecter to be minimized.

Other objects and advantages besides those discussed above will be apparent to those skilled in the art from the description of a preferred embodiment of the invention which follows. In the description, reference is made to the accompanying drawings, which form a part hereof, and which illustrate one example of the invention. Such example, however, is not exhaustive of the various alternative forms of the invention, and therefore reference is made to the claims which follow the description for determining the full scope of the invention.

DESCRIPTION OF THE PREFERRED EMBODIMENT

Figure 1:
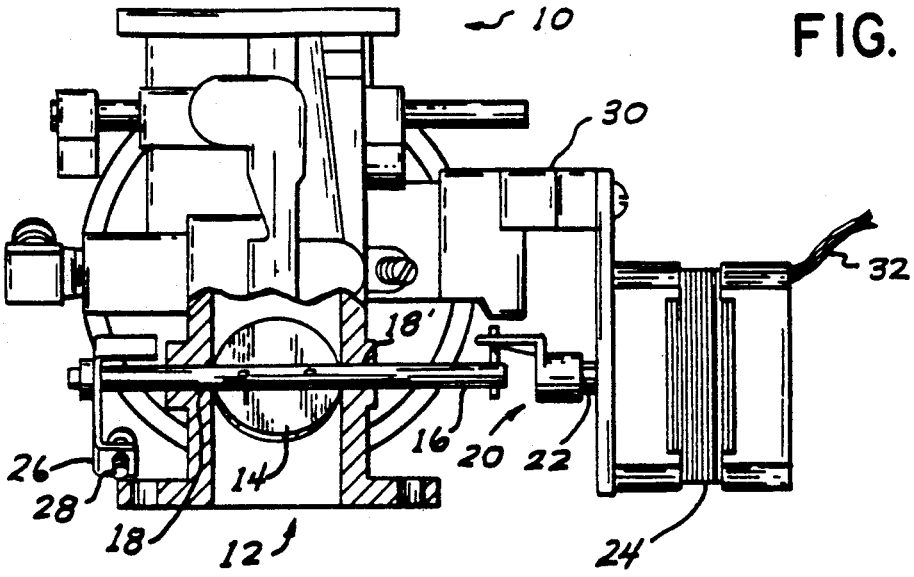
FIG. 1 is a view of a throttle housing for an internal combustion engine with portions cut away to reveal the throttle plate and shaft, and showing the direct connection of the stepper motor to the throttle by means of the co-axial coupling.

Referring to FIG. 1, a carburetor 10 such as may be used with an 18 HP 1800 RPM gasoline engine, contains a cylindrical throat 12 for mixing and guiding a mixture of air and gasoline to the intake manifold (not shown). Within the throat 12 of the carburetor 10 is a disc-shaped throttle plate 14 mounted on a throttle shaft 16 so as to rotate the throttle plate 14 about a radial axis by approximately 90° to open and close the throat 12 to air and gasoline flow. The shaft 16 is guided in its rotation by holes 18 in opposing walls of the throat 12. One end of shaft 16 extends outside of the throat 12 through one such hole 18' so as to be externally accessible. The externally accessible end of the shaft 16 is connected to a co-axial coupling 20 which in turn connects the shaft 16 to an axially aligned motor shaft 22 of a stepper motor 24. The shaft 16 also carries a stop arm 26 extending radially from the shaft 16 and having an idle adjusting screw 28 facing circumferentially with respect to motion of the stop arm 26. The stop arm 26 serves to limit the rotation of the shaft 16 and the throttle plate 14 within the throat 12 to control the idle and maximum speed of the engine, as is generally understood in the art. The idle speed may be adjusted by means of idle adjusting screw 28.

Figure 2:
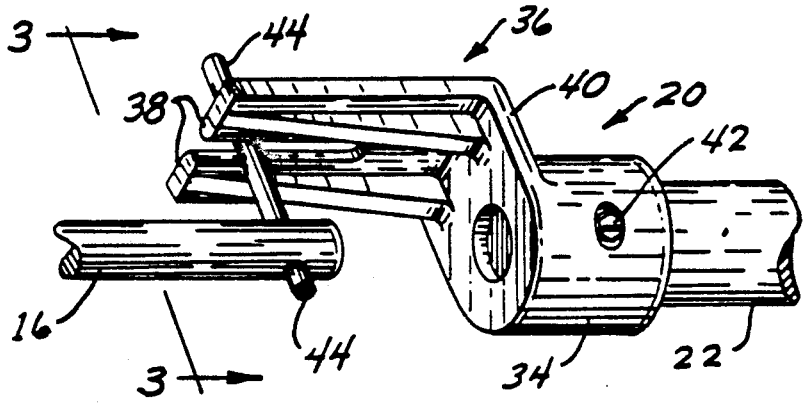
FIG. 2 is a detailed perspective view of the co-axial connecter of FIG. 1.

Referring to FIG. 2, the co-axial coupling 20 is comprised of a collar 34 for receiving the motor shaft 22. A guide fork 36 comprised of two parallel guide bars 38 oriented parallel to the axis of the motor shaft 22, is attached to the collar 34 by means of an offset arm 40. The offset arm 40 holds the guide fork 36 and guide bars 38 at a position displaced from the axis of the motor shaft 22.

The collar 34 may be attached to the motor shaft 22 by means of a set screw 42 received by an radial tapped hole in the collar 34. When the collar 34 is so attached to the motor shaft 22, the guide bars 38 extend toward the throttle shaft 16 to receive a torque pin 44 extending radially from the throttle shaft 16. The torque pin 44 is press fitted into a radial hole through the throttle shaft 16.

Figure 3:
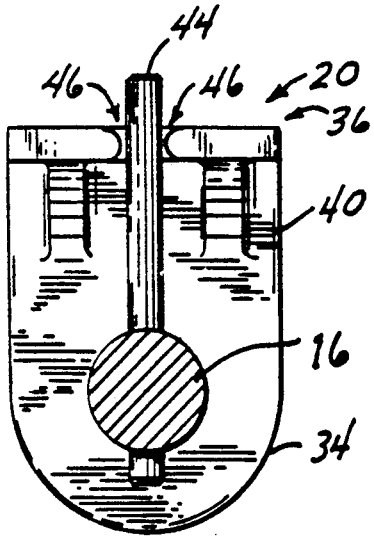
FIG. 3 is a cross-sectional view of the connector of FIG. 2 along lines 3—3 showing the operation of the connecter without transverse misalignment.

Referring to FIG. 3, the torque pin 44 fits between the opposed faces 46 of the guide bars 38 so as to turn the throttle shaft 16 with rotational movement of the motor shaft 22. It will be understood from the physical description of the coupling 20 that the torque pin 44 and hence the throttle shaft 16 is free to move axially with respect to the motor shaft 22 without movement of the motor shaft 22 or obstruction of the torque pin 44 by the guide bars 38. For similar reasons, the axis of the throttle shaft 16 may be tipped slightly with respect to the axis of the motor shaft 22 without adverse affect on the operation of the coupling 20.

Figure 4:
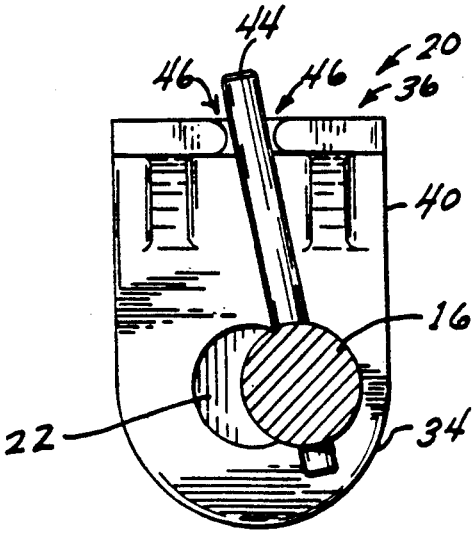
FIG. 4 is a cross-sectional view of the connector of FIG. 2 along lines 3—3 showing the operation of the connecter with transverse misalignment.

Referring to FIG. 4, the throttle shaft 16 and the motor shaft 22 may also be translated without rotation with respect to one another by a small amount and still be coupled by the coupling 20. Such translation will cause the torque pin 44 to pass between the guide bars 38 at an angle with respect to the face of the guide fork 36, however, the faces 46 of the guide bars 38 are given a convex radius to allow limited freedom of movement in this direction without requiring that the gap between the faces 46 of the guide bars 38 be unnecessarily expanded with a corresponding increase in the rotational play of the coupling 20.

Referring again to FIG. 1, the stepper motor 24 is affixed to the carburetor 10 means of a mounting bracket 30 which orients the stepper motor 24 so that its shaft 22 is substantially coaxial with the throttle shaft 16 as described above. The stepper motor 24 is of a bidirectional design capable of stepping continuously in either direction with an angular resolution of 1.8° per step. The stepper motor 24 contains two windings controlled by four electrical leads 32 which may be independently connected with electrical power in a predetermined sequence to cause the stepper motor 24 to step by a predetermined amount in either direction. It will be apparent from the following discussion that other such stepper motors 24 with differing angular resolution may also be used.

It should be noted that no return spring is employed with the stepper motor 24 and hence the stepper motor 24 need only overcome the forces on the throttle shaft 16 resulting from pressure on the throttle plate 14 from air flow and the minimal resistance of friction between the throttle shaft 16 and the holes 18 in the throat 12. Accordingly, the stepper motor 24 may be less expensive and lighter than a comparable linear actuator. The speed of commercially available stepper motors 24 is dependant in part on their angular resolution. Accordingly, there is a trade-off between throttle response time and positioning accuracy. As will be understood to one of ordinary skill in the art, depending on the application, stepper motors 24 having different numbers of steps per revolution may be selected to tailor the stepper motor 24 to the requirements of speed and accuracy.

The direct coupling of the stepper shaft 22 to the throttle shaft 16 provides a constant torque transmission between stepper motor 24 and the throttle plate 14, unlike that provided by the linkage couplings typical with linear actuators. This constant torque transmission eliminates the need for an oversized motor 24 and simplifies the adaptation of the throttle controller (not shown) associated with the carburetor to different engines and carburetors.

Figure 5:
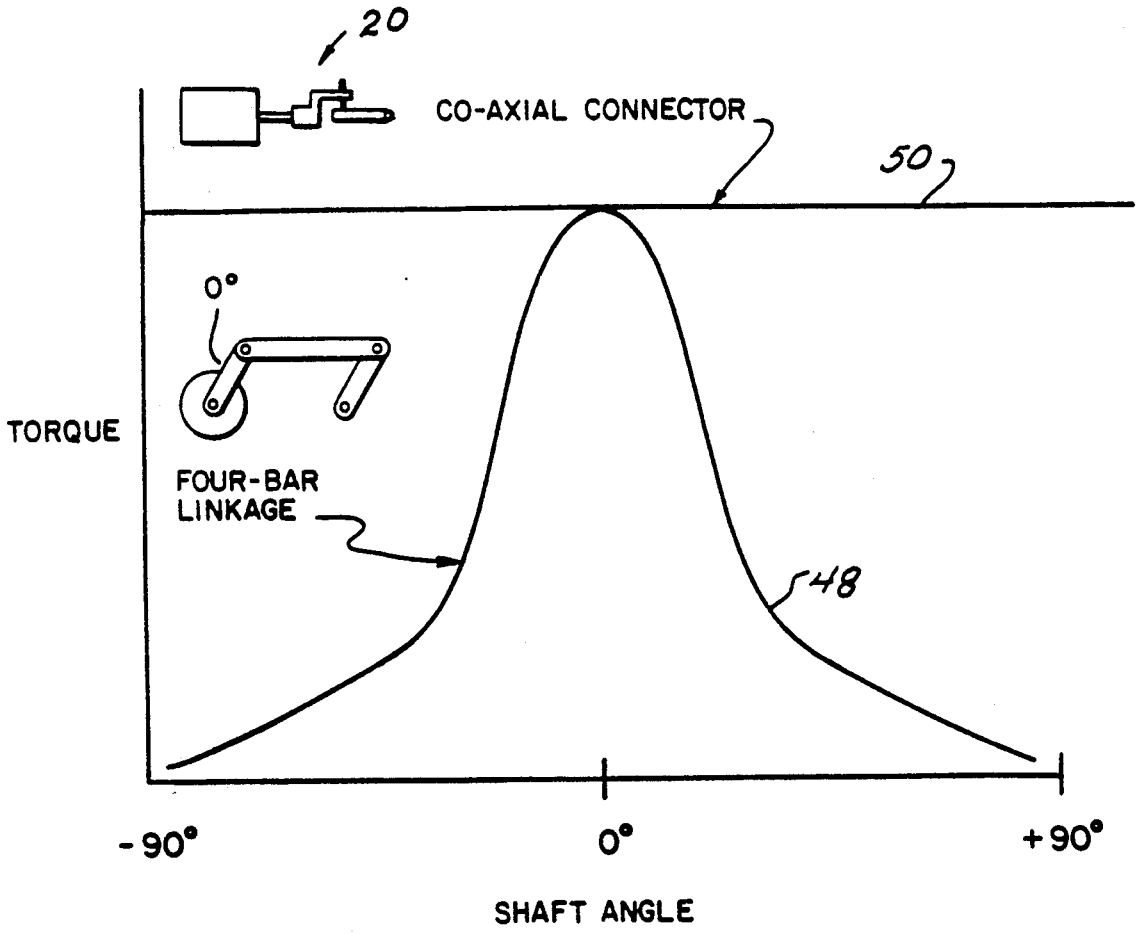
FIG. 5 is a chart showing the torque transmission of a four bar linkage and of the co-axial connector of the present invention.

Referring to FIG. 5, the torque of a typical four-bar linkage, such as has been used previously to connect a throttle and stepper motor, is shown. The torque varies with the angle of the connecting rod to the crank arms, one of which may be attached to a motor, and one of which may be attached to a throttle shaft. When the crank and connecting rod are parallel (at shaft angles 90° or −90° as shown in FIG. 5) no torque is transmitted. This position is often referred to as a dead center position. The maximum torque of the motor is transmitted only when the crank arms and the connecting rod are perpendicular (0° as shown in FIG. 5). For all other angles the torque is generally proportional to the $\cos^2$ of the angle as indicated by line 48. In comparison, the torque transmitted by the co-axial connector 20 is constant for all angles as indicated by line 50.

Unlike the linear actuator, the stepper motor 24 may start at any position and, without a position sensor, there will be no indication of the current position the shaft 22 of the stepper motor 24. This lack of a fixed "home" position of stepper motor 24 simplifies assembly of the carburetor 10 and stepper motor 24 because rotational alignment of the stepper shaft 22 and the throttle shaft 16 is not critical. However, this feature of stepper motors 24 requires that special throttle controller circuitry be used. One such throttle control circuit is described in co-pending application Ser. No. 07/538,289 filed on June 14, 1990, entitled: Stepper Motor Throttle Controller, assigned to the same assignee as the present invention and hereby incorporated by reference.

The above description has been that of a preferred embodiment of the present invention. It will occur to those who practice the art that many modifications may be made without departing from the spirit and scope of the invention. In order to apprise the public of the various embodiments that may fall within the scope of the invention, the following claims are made:

We claim:

1. An engine throttle for changing the flow rate of mixed air and fuel to an internal combustion engine in response to a electric control signal comprising:

a throttle valve contained in the throttle housing and attached to the rotatable shaft for opening and closing with rotation of the shaft and controlling the flow rate of mixed air and fuel to the engine;

a stepper motor having an outer housing supporting a motor shaft axially aligned with the rotatable shaft;

a co-axial coupling attached to the rotatable shaft and the motor shaft for providing a constant transmission of torque therebetween without substantial rotational play between the rotatable shaft and the motor shaft and accommodating angular, axial and translational misalignment between the rotatable shaft and the motor shaft, and accommodating axial and translational movement between the rotatable shaft and the motor shaft; and a mounting means for affixing the outer housing of the stepper motor with respect to the throttle housing.

2. An engine throttle for changing the flow rate of mixed air and fuel to an internal combustion engine in response to a electric control signal comprising:

a throttle housing supporting a rotatable shaft;

a throttle valve contained in the throttle housing and attached to the rotatable shaft for opening and closing with rotation of the shaft and controlling the flow rate of mixed air and fuel to the engine;

a stepper motor having an outer housing supporting a motor shaft axially aligned with the rotatable shaft;

a co-axial coupling attached to the rotatable shaft and the motor shaft for providing a constant transmission of torque therebetween and accommodating angular, axial and translational misalignment between the rotatable shaft and the motor shaft, and accommodating axial and translational movement between the rotatable shaft and the motor shaft; and a mounting means for affixing the outer housing of the stepper motor with respect to the throttle housing;

wherein the co-axial coupling comprises:

an offset arm for mounting on a first shaft and for extending perpendicular to the axis of the first shaft;

a guide fork attached to the free end of the offset arm having two guide bars extending parallel to, but displaced from, the axis of the first shaft; and a torque pin for attachment to a second shaft and for extending perpendicular to the axis of the second shaft and for being received between the guide bars.

3. The connector of claim 2 wherein the first shaft is the motor shaft and the second shaft is the rotatable shaft.

4. The connector of claim 2 wherein the torque pin is received between faces of the guide bars which are spaced apart by the thickness of the torque pin and wherein the faces of the guide bars are convex.

* * * * *

UNITED STATES PATENT AND TRADEMARK OFFICE

CERTIFICATE OF CORRECTION

PATENT NO. : 5,033,433

DATED : July 23, 1991

INVENTOR(S) : Churchill et al.

It is certified that error appears in the above-identified patent and that said Letters Patent is hereby corrected as shown below:

Col. 6, line 9, (claim 1)
after "comprising:" insert --a throttle housing supporting a rotatable shaft;--

Signed and Sealed this

Twenty-seventh Day of October, 1992

*Attest:*

DOUGLAS B. COMER

*Attesting Officer*

*Acting Commissioner of Patents and Trademarks*